US005390526A

United States Patent [19]

Balázs et al.

[11] Patent Number: 5,390,526

[45] Date of Patent: Feb. 21, 1995

[54] DOUBLE-PROFILE DRAWING TOOL

[75] Inventors: György Balázs, Hajdudorog; Sándor Cébely, Hajdunánás; Jenö Jádi, deceased, late of Hajdunánás; János Kûsz, Göd; András Mónus, Hajdûnáns; Lajos Nagy, Hajdunánás; József Varga, Budapest, all of Hungary

[73] Assignee: Tungsram Co., Ltd., Hungary

[21] Appl. No.: 150,661

[22] Filed: Nov. 9, 1993

[51] Int. Cl.[6] ..... B21C 3/02

[52] U.S. Cl. ..... 72/467

[58] Field of Search ..... 72/467; 76/107.4

[56] References Cited

U.S. PATENT DOCUMENTS

| | | | |
|---|---|---|---|
| 1,986,777 | 1/1935 | Patterson | 72/467 |
| 2,003,475 | 6/1935 | Shipp | 72/467 |
| 4,241,625 | 12/1980 | Corbin | 72/467 |
| 4,365,502 | 12/1982 | Carson | 72/467 |
| 4,442,734 | 4/1984 | Carson | 76/107.4 |

FOREIGN PATENT DOCUMENTS

| | | | |
|---|---|---|---|
| 682336 | 10/1939 | Germany | 72/467 |
| 622509 | 5/1949 | United Kingdom | 72/467 |

*Primary Examiner*—Daniel C. Crane

*Attorney, Agent, or Firm*—George E. Hawranko; Stanley C. Corwin

[57] ABSTRACT

A double profile drawing tool includes a mandrel having a profile drawing die formed therein with first and second portions extending in opposite directions, associated therewith. The mandrel is disposed in a supported surrounding manner within a structure including a housing body and an embedding component. The embedding component is securely fixed within the housing body by way of a support plate which is joined to the housing body in a shrink fit manner. The structure formed by the housing body, support plate, with the mandrel and embedding component contained therein, is then securely mounted within a U-shaped outer housing member. First and second tapered openings are formed on opposite sides and along the longitudinal axis of the double profile drawing tool, such tapered openings providing communication to the first and second portions of the profile drawing die from opposite directions. The double profile drawing tool can be reversed for operation in an opposite direction once it has been determined that one portion of the profile drawing die has been worn. In either direction of operation, the mandrel is positively supported so as to prevent movement and to insure that a substantial portion of loading forces are directed away from the profile drawing die.

6 Claims, 1 Drawing Sheet

Fig. 1
(PRIOR ART)
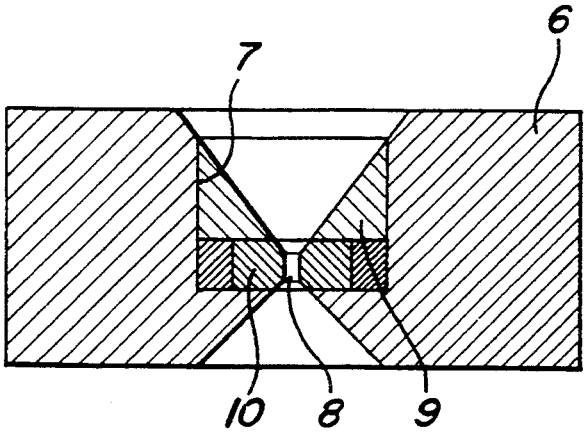
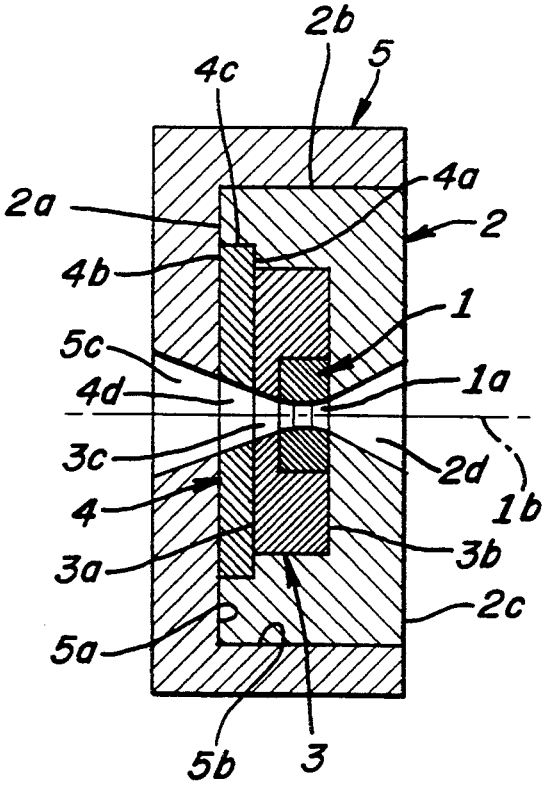
Fig. 2

DOUBLE-PROFILE DRAWING TOOL

FIELD OF THE INVENTION

This invention relates to a double profile drawing tool as may by used in the lighting industry for the manufacture of lamp lead wires. More particularly, this invention relates to such a double profile drawing tool as includes an arrangement for securing a mandrel in a holder in an embedded manner so as to ensure a maintained rigid mounting of the mandrel irrespective of the direction of insertion of the wire to be drawn.

BACKGROUND OF THE INVENTION

In the field of wire production, the manufacturing process based on drawing has widespread use. The drawing tools used in this process generally have a wear-resistant inner mandrel and a holding body which encloses and secures the mandrel against displacement. In the middle of the mandrel, a profile drawing die is placed for the purpose of adjusting wire diameter to the exact value desired.

In a conventional wire production manufacturing process, a significant number of drawing tools employ a profile die formed in the mandrel which allows drawing the raw wire from one direction only. In conjunction with this single direction drawing tool die, the holder enclosing the mandrel may in practice also be loaded from one direction only. Drawing tools of this type are described in U.S. Pat. Nos. 4,144,739; 4,365,502 and 4,392,397.

For the single direction drawing tool arrangements set forth in the above 3 U.S. patents, there is an inherent disadvantage in that, once the die has been worn down due to high loading thereby resulting in a worn and fissured surface on the profile drawing die, such die can only be salvaged by repair to a limited extent. In other words, such die may be cut down (e.g. expanded in size) to remove the uneven, worn or fissured surfaces, but only to the extent that the resultant smooth surface of the die, has a dimension that allows the drawing of the raw wire therethrough so as to maintain the finished product at a dimension within the upper tolerance limit of the wire cross-section. Of course, when the upper tolerance limit is exceeded, the tool can no longer be used for drawing the given wire. It can be a appreciated that in high speed manufacturing operations, the need to stop the automated system in order to do a tool change-over is inefficient both in terms of time and cost and therefore should be minimized. In order to alleviate this problem and to increase tool lifetime, "double-profile" drawing tools were developed wherein the mandrel has a profile drawing die suitable for bi-directional use. A drawing tool of this type is described in U.S. Pat. No. 4,462,242. Though providing the advantage of extended life over the drawing tool having a single direction operation, the double-profile drawing tool of this patent has the disadvantage of providing a less secure mounting arrangement of the mandrel within the housing body. As such, in the case of when a hot drawing process is used, the temperature rise due to high loading on the mandrel can cause the mandrel to loosen thereby resulting in a failure of the drawing tool. To explain this, it should be understood that the means for securely mounting the mandrel within the housing body so as to prevent displacement or the exercise of undue stresses to the tool during high speed operation, must allow for the ability to load the tool to its maximum capacity even if such capacity causes a temperature rise. If the holder body enclosing the mandrel is a band that does not fit appropriately to the mandrel so as to securely encircle the mandrel or perhaps reduce or take-up some of the load forces to which the mandrel is exposed, the mandrel can crack and become unstable. Additionally, if the mandrel is not secured against movement, the profile die can come out of alignment thereby resulting in a change of the optimum forming profile in using the drawing tool.

SUMMARY OF THE INVENTION

Accordingly, it is an object of our invention to provide a drawing tool configuration that achieves a long life at a high quality performance level and wherein the mandrel containing the drawing profile die is fixedly secured within a housing body to insure sufficient loadability of the mandrel regardless of the direction of operation.

It is a further object of this invention to provide such increased lifetime drawing tool configuration having a secure mounting arrangement allowing maximum loadability which can be easily implemented in terms of cost and construction characteristics. The concept of the present invention is based on the recognition that the above objects can be achieved by providing the housing body in an enclosing relation to the mandrel and with an additional embedding arrangement that differs from known designs by joining the components of the embedding arrangement to one another and to the housing body in a novel manner.

In accordance with the principles of the present invention, there is provided e double-profile drawing tool applicable in the manufacture of lead wires used in electric lamps, which drawing tool includes a mandrel having a double sided profile drawing die fixedly mounted within a housing body by means of an embedding component. The mandrel is further securely mounted within the housing body by use of a support plate member which is positioned on the outer side of the embedding component and extends to the front surface of the housing body so as to also be enclosed therein. Thereafter, the structure including the mandrel, embedding component and housing body is further enclosed on a substantial portion thereof, by an outer housing component secured to this structure in a compression fit manner. Another feature of the double-profile drawing tool of the present invention is that the embedding component can be made from a metal powder and hardened by sintering. In the preferred embodiment of this invention, the support plate is fixed to the housing body by means of a shrinkage fit. Also, it is possible to secure the outer housing to the housing body by means of such a shrinkage fit.

BRIEF DESCRIPTION OF THE DRAWING

The foregoing, and further objects and advantages of the invention, will become apparent from the following description taken in conjunction with the drawing in which:

FIG. 1 is an elevational view in section of a drawing tool constructed in accordance with the teachings of the prior art.

FIG. 2 is an elevational view in section of a double-profile drawing tool constructed in accordance with the present invention.

DETAILED DESCRIPTION OF THE INVENTION

As seen in FIG. 1, the drawing tool of the prior art taken from previously cited U.S. Pat. No. 4,392,397 includes a metal annulus 6 having a bore 7 formed therein. A core member 10, having a die 8 formed therein is clamped within bore 7 by means of a clamping member 9. The double profile drawing tool of the present invention and as will be described hereinafter with reference to FIG. 2, has several advantages over this prior art drawing tool. The most important advantage is that the double profile drawing tool can be equally loaded from both directions whereas the drawing tool of FIG. 1 can only drawn from the top direction as shown in the figure. The die 8 of core member 10 shown in FIG. 1 cannot be used on its opposite side once the original side has been worn down or damaged thereby significantly limiting the life of such drawing tool configuration. Additionally, it should also be considered an advantage over the prior art that the double profile drawing tool of the present invention can secure the mandrel to withstand load displacements and that it counterbalances a significant part of the compression stresses (i.e. the stresses from the tensile force), which are present during hot drawing and to which the mandrel is exposed. In other words, a significant amount of the compression stresses are prevented from adversely impacting the die. Such forces are instead directed to the novel mounting/securing arrangement of the present invention wherein a lower stress gradient appears at the mandrel and the housing body is able to take over the loads on a larger surface area thereby minimizing the risk of failure and lengthening the lifetime of the tool.

As seen in FIG. 2, the double profile drawing tool of the present invention includes a mandrel 1 which is provided with a profile drawing die 1*a*. The mandrel 1 is connected to a housing body 2 by means of an embedding component 3. The embedding component 3 is made from a metal powder and the mandrel 1 is placed in the embedding component 3 prior to sintering the metal powder. Once sintered, there is a secure metal joint formed between the mandrel 1 and the housing body 2.

The outer side 3*a* of the embedding component 3 is also parallel to the joining surface 4*b* of a support plate 4, which joining surface 4*b* is in the same plane as the front surface 2*a* of the housing body 2. In this embodiment, the mantle surface 4*c* of support plate 4 is cylindrical and has a bore 4*d* which is located centrally in the support plate 4 and is disposed along the longitudinal axis 1*b* of the profile drawing die 1*a* of mandrel 1.

The material of the support plate 4 is preferably a high-strength steel. The support plate 4 is fixedly secured in a preformed seat in the housing body 2 in such a way that when the housing body 2 is heated and the support plate 4 is at room temperature when positioned within the preformed seat, a secure fitting results thereby. By such fitting process, after the housing body 2 has cooled down, a shrinkage fitting allowing for high loading capabilities will be produced between the housing body 2 and the support plate 4. Such shrink fitting effectively securely encloses the embedding component 3 within the housing body 2 allowing for such high loading capabilities.

Surrounding the front surface 2*a* and side surfaces 2*b* of the housing body 2, as well as the front surface 4*b* of support plate 4, is an essentially U-shaped outer housing member 5 which is joined to the housing body 2 and support plate 4 configuration in a compression fit manner or a heat shrink manner as previously discussed. The bordering mantle surface 5*b* of the outer housing member 5 contacts the side surfaces 2*b* of housing body 2 and the inner front surface 5*a* of outer housing member 5 contacts the front surface 2*a* of housing body 2 and front surface 4*b* of support member 4. A firm joint is formed between the outer housing member 5 and the housing body 2, support plate 4 configuration by a similar shrinkage fitting process as was described previously. An inward tapering aperture 5*c* is formed in the front side of outer housing member 5 and connects with similarly inward tapered openings formed in the support plate 4, embedding component 3, and, on the opposite side of the mandrel 1, an outwardly tapering aperture 2*d* is formed on the housing body 2.

When using the double-profile drawing tool of the present invention, the tool is first secured in a clamping fixture of the wire drawing machine (not shown) so that the raw wire material to be processed, can be inserted into the profile drawing die 1*a* of the mandrel 1 in the following sequence: firstly across the aperture 5*c* of the outer housing member 5, then across a bore 4*d* formed in support plate 4, and then across the hole 3*c* formed in the embedding component 3. It is practical to produce the final profile for drawing wire only at that side of the profile drawing die 1*a* of the mandrel 1 which is closer to the hole 3*c* formed in the embedding component 3, and to leave the other side unpolished.

The double-profile drawing tool is used in this fixed position until microscopic defects appear on the surface of the profile drawing die 1*a* of mandrel 1. When such defects occur, the double-profile drawing tool is reversed and the other side of the profile drawing die 1*a* is utilized. This other side of the profile drawing die 1*a* at such time, has not yet been loaded and, is accessed through the aperture 2*d* formed in the housing body 2. In this manner, the double profile drawing tool reversed for use in this opposite direction, is clamped in the fixture of the drawing machine for continued operation in such a way that the raw wire material is introduced thereto through the aperture 2*d*.

Although the hereinabove described embodiment constitutes the preferred embodiment of the invention, it is to be understood that modifications may be made thereto without departing from the scope of the invention as set forth in the appended claims. For instance, although described in relation to use with wire materials, the double profile drawing tool of the present invention could be equally effective when used in conjunction with plastic parts to be drawn. Additionally, joining methods other than the described shrinkage fitting approach could be utilized for securing the outer housing member to the housing body, support plate configuration.

We claim:

1. A double-profile drawing tool for drawing lead wires in the production of electric lamps, said double-profile drawing tool comprising:

a mandrel having formed therein, a profile drawing die having first and second portions associated therewith, said first and second portions being formed in opposing directions and being substantially similar to one another;

a housing body contacting at least a portion of said mandrel so as to support said mandrel thereby;

an embedding component contained within said housing body and in contact with a substantial portion of said mandrel so as to, in cooperative conjunction with said housing body, surround and support said mandrel therein;

a support plate member abutting said embedding component at an interface formed by an inner side of said support plate member and an outer side of said embedding component, said support plate member abutting a first front surface of said housing body, said support plate member being joined to said housing body in a secure manner so as to prevent displacement of said embedding component and said mandrel within said housing body;

an outer housing member disposed in surrounding relation to at least a portion of said housing body, an inner side of said outer housing member abutting at least a portion of an outer side of said support plate member and a second front surface of said housing body, said outer housing member being joined to said housing body in a fixed manner; and said mandrel, housing body, embedding component, support plate member and outer housing member arranged to form the double-profile drawing tool with a longitudinal axis, first and second tapered openings formed along the longitudinal axis of said double profile tool and extending through said outer housing member, said support plate, said embedding member and said housing body so as to provide communication to said first and second portions of said profile drawing die.

2. A double-profile drawing tool as set forth in claim 1 wherein said embedding component is constructed of a metal powder and is joined to said housing body by sintering said metal powder.

3. A double profile drawing tool as set forth in claim 1 wherein said support plate is joined to said housing body in a shrink fit manner.

4. A double profile drawing tool as set forth in claim 1 wherein said outer housing member is generally U-shaped in cross-section and surrounds said second front surface of said housing body and said outer side of said support plate member and further surrounds the side surface of said housing body.

5. A double profile drawing tool as set forth in claim 1 wherein said first and second tapered openings formed through said outer housing member, said support plate, said embedding component and said housing body are constructed so as to take up a substantial portion of load forces associated with the process of drawing raw wire material through said double profile drawing tool, thereby reducing the amount of such load forces as are exerted on said mandrel.

6. A double profile drawing tool as set forth in claim 1 wherein said housing body forms a seat for said support plate member.

* * * * *